US007155886B2

(12) United States Patent
Peterson

(10) Patent No.: US 7,155,886 B2
(45) Date of Patent: Jan. 2, 2007

(54) ADJUSTABLE DEE RINGS FOR SADDLES AND METHOD OF USE

(75) Inventor: Brian Charles Peterson, Celeste, TX (US)

(73) Assignee: Equibrand Products Group LP, Granbury, TX (US)

( * ) Notice: Subject to any disclaimer, the term of this patent is extended or adjusted under 35 U.S.C. 154(b) by 0 days.

(21) Appl. No.: 10/867,408

(22) Filed: Jun. 14, 2004

(65) Prior Publication Data

US 2005/0284112 A1 Dec. 29, 2005

(51) Int. Cl.
*B68C 1/16* (2006.01)
*B68C 1/02* (2006.01)

(52) U.S. Cl. ..... 54/46.2; 54/44.1

(58) Field of Classification Search ..... 54/44.1, 54/44.3, 46.1, 46.2, 38.1, 42.1, 40.1, 47, 54/23

See application file for complete search history.

(56) References Cited

U.S. PATENT DOCUMENTS

| | | | | | |
|---|---|---|---|---|---|
| 34,044 | A | * | 12/1861 | Eagle | 54/46.2 |
| 263,822 | A | * | 9/1882 | Spence, Jr. | 54/46.2 |
| 321,830 | A | * | 7/1885 | Macleod | 54/46.2 |
| 327,165 | A | * | 9/1885 | Haslam | 54/46.2 |
| 521,552 | A | * | 6/1894 | Reed | 54/23 |
| 539,461 | A | * | 5/1895 | Weeks | 54/46.2 |
| 577,541 | A | * | 2/1897 | Wagemann | 54/46.2 |
| 1,335,826 | A | * | 4/1920 | Folliott | 54/46.2 |
| 2,091,897 | A | * | 8/1937 | Vance | 54/46.1 |
| 2,464,881 | A | | 3/1949 | McClellan | |
| 2,739,434 | A | * | 3/1956 | Bell | 54/46.2 |
| 4,473,992 | A | | 10/1984 | Conger, III | |
| 4,782,649 | A | | 11/1988 | Zubrod | |
| 4,924,660 | A | * | 5/1990 | Norman et al. | 54/46.2 |
| 5,261,212 | A | | 11/1993 | Debord | |
| 5,355,660 | A | * | 10/1994 | Shimon | 54/46.2 |

* cited by examiner

*Primary Examiner*—Son T. Nguyen
(74) *Attorney, Agent, or Firm*—John H. Miller

(57) ABSTRACT

Adjustable Dee ring embodiments are disclosed that allow the saddle and/or the billet or Latigo to be located in an optimum position on the horse. The adjustable Dee ring is light weight and a billet or Latigo can be easily and quickly adjusted laterally within a frame of the Dee ring by moving a billet holder or Latigo holder generally vertically a very small distance to unlock it for lateral movement, then moving it laterally and lowering it into the desired position to engage one or more locking features on the frame. Methods of using the adjustable Dee ring and of making a saddle comprising the adjustable Dee ring are also disclosed.

17 Claims, 7 Drawing Sheets

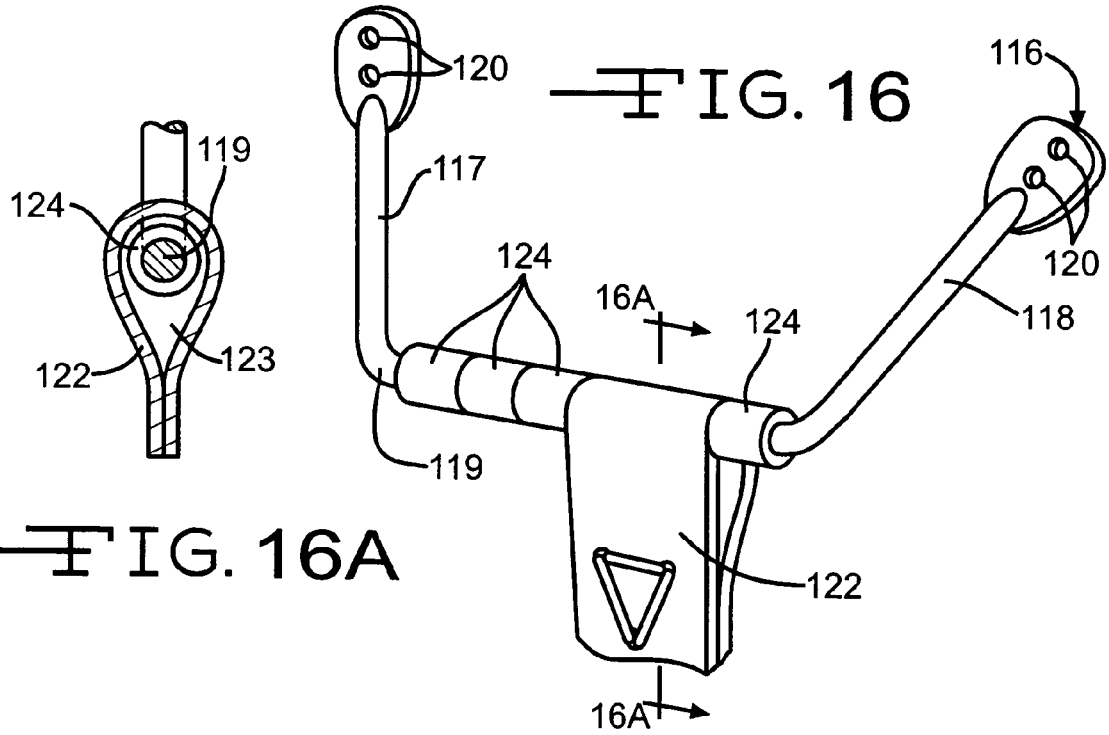
FIG. 16
FIG. 16A
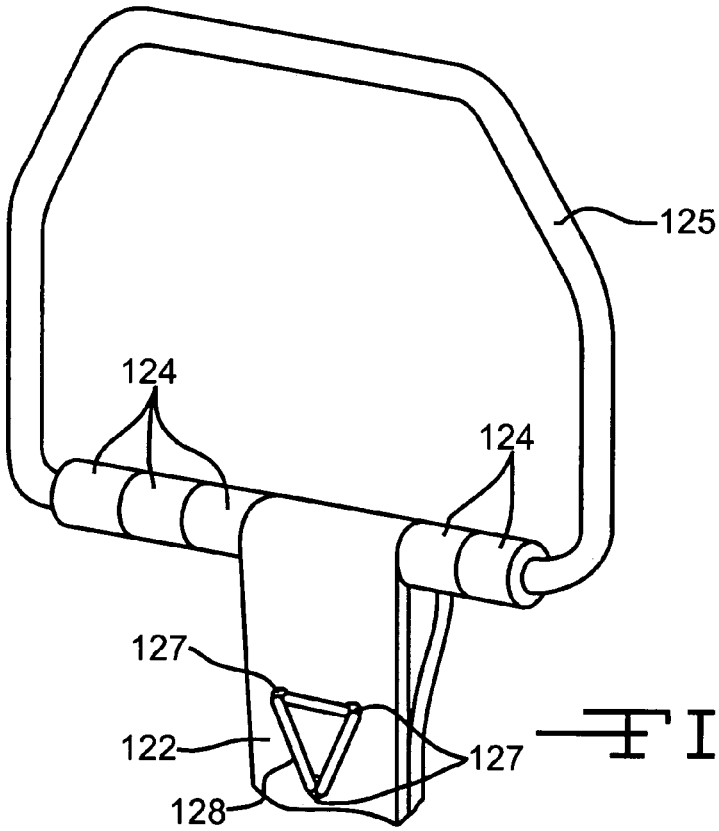
FIG. 17

ADJUSTABLE DEE RINGS FOR SADDLES AND METHOD OF USE

The invention involes adjustable Dee rings for saddles that allow the rigging to be adjusted to place the saddle in the optimum position for the horse and the task at hand and a method of using the adjusted Dee rings.

BACKGROUND

It is known to use adjustable rigging on a saddle to allow optimum placement of the saddle and/or the billets on the horse or other type of equine. These adjustable riggings are disclosed in U.S. Pat. Nos. 2,464,881 and 4,473,992. The Dee rings used in these adjustable riggings work, but are heavy and have a further disadvantage of requiring that the billet be loosened substantially, or removed entirely, to make an adjustment.

Much equine activity today is involved in competitive events where speed and ease of use is extremely important. In roping events, barrel racing, and other events split seconds are vitally important and to achieve top paying times the precision and ease of use of the equipment are crucial. A lighter weight and simpler adjustable Dee ring that is easily and quickly adjusted after the saddle has initially been cinched up would be very useful on adjustable rigging saddles.

SUMMARY OF PREFERRED EMBODIMENTS

The invention includes an adjustable Dee ring for a saddle that comprises a frame having a generally lateral member and a movable billet or Latigo holding member, the billet or Latigo holding member being significantly movable generally laterally only after moving the billet or Latigo holding member generally vertically upward a distance of less than about one inch, the movable billet or Latigo holding member being held in a substantially laterally fixed-position by engaging a lateral member when the billet is in operating condition on an animal such as a horse. While the present invention is useful on a saddle for most any animal, and certainly any equine, the most common use is for a horse and for purposes of simplification, the term horse will be used, not as a limiting term, but as a short hand descriptor of any beast of burden. By engaging is meant that two members are in contact with one another in such a way as to prevent one of the members from moving laterally substantially with respect to one another. A very small amount of lateral movement can occur due to the need for small clearances, at least in most embodiments, to permit rapid engagement of engaging surfaces, but this small amount of lateral movement is insignificant or not substantial.

Preferably the adjustable billet or Latigo holding member can be moved laterally after it is moved generally vertically a distance of less than about ½ inch, more preferably less than about ¼ inch and most preferably less than about 3/16 inch, such as less than about ⅛ inch. By generally vertically is meant from vertical to plus or minus about 30 degrees off of vertical. By generally laterally is meant from horizontal to plus or minus about 30 degrees, preferably about 20 degrees and more preferably about 10 degrees and most preferably about 8 degrees from horizontal. By substantially latterly fixed position means that the billet holding member can either not move generally laterally or can move only a small amount equivalent to clearances required.

Numerous locking configurations between the generally lateral member and the movable billet or Latigo holding member can be used to satisfy the invention described above. In a preferred embodiment projections of various shapes on one of these members enter into recesses of similar or close to the same shapes in the other member to prevent substantial lateral movement of the billet or Latigo holding member. Some clearance between the projections and the recesses are necessary to permit the projections to rapidly enter the desired recesses, and the projections need not contact all of the side surfaces of the recesses to provide the locking function as will be seen in the. detailed description.

The preferred embodiments of the invention do not rely only on gravity and the tension on the billet or Latigo to hold the billet or Latigo holding member in a locked position, but also comprise a biasing member such as a spring of some type or a compressible material to bias the projections on one member into the recesses in the other member.

In a less preferred embodiment of the invention, the billet or Latigo is prevented from substantial lateral movement by two or more movable spacers on a lateral member of the frame. In this embodiment the billet or Latigo is moved generally vertically less than 1 inch, preferably less than 0.5 inch, to permit the spacers to be moved latterly to reposition the billet or Latigo on the D-ring, or saddle.

The frame of the Dee ring of the present invention can be of various configurations depending mainly on the intended use of the saddle, i.e. for roping, barrel racing, etc. The frame can attach in different manners as is known for heavy duty or for lighter duty. The frame can be attached with straps of leather or other strong material to the saddle tree and saddle skirt, fastened to a skirt of the saddle with rivets, brads or other known means, or attached by sewing to the skirt or other methods of attachment. Normally, working saddles have both front and rear Dee rings, but it is not necessary that they both be of the same type or that they be attached in the same manner. Usually it is most important to use adjustable Dee rings on the front, but they can also be used on the rear.

The present invention also includes a method of making a saddle comprising attaching an adjustable rigging comprising an adjustable Dee ring to the tree and/or the skirt of a saddle, the improvement comprising selecting as the adjustable Dee ring one that comprises a frame and a movable billet holding member, the billet holding member being movable generally laterally only after moving said member generally vertically upward a distance of less than about one inch, and preferably much less, the movable billet holding member being held in a substantially laterally fixed position when the billet is in an operating condition on an equine.

When the word "about" is used herein it is meant that the amount or condition it modifies can vary some beyond that so long as the advantages of the invention are realized. Practically, there is rarely the time or resources available to very precisely determine the limits of all the parameters of ones invention because to do would require an effort far greater than can be justified at the time the invention is being developed to a commercial reality. The skilled artisan understands this and expects that the disclosed results of the invention might extend, at least somewhat, beyond one or more of the limits disclosed. Later, having the benefit of the inventors disclosure and understanding the inventive concept and embodiments disclosed including the best mode known to the inventor, the inventor and others can, without inventive effort, explore beyond the limits disclosed to determine if the invention is realized beyond those limits and, when embodiments are found to be without any unexpected characteristics, those embodiments are within the meaning of the term about as used herein. It is not difficult for the artisan or others to determine whether such an embodiment is either as expected or, because of either a break in the continuity of results or one or more features that are significantly better than reported by the inventor, is surprising and thus an unobvious teaching leading to a further advance in the art.

BRIEF DESCRIPTION OF THE DRAWINGS

FIG. 16 is a perspective view of another embodiment of the invention.

FIG. 16A is a cross section along lines 16A—16A of FIG. 16 to show a how spacers are moved in this embodiment of the invention.

FIG. 17 is a perspective view of another embodiment of the invention.

DETAILED DESCRIPTION OF PREFERRED EMBODIMENTS

Figure 1:
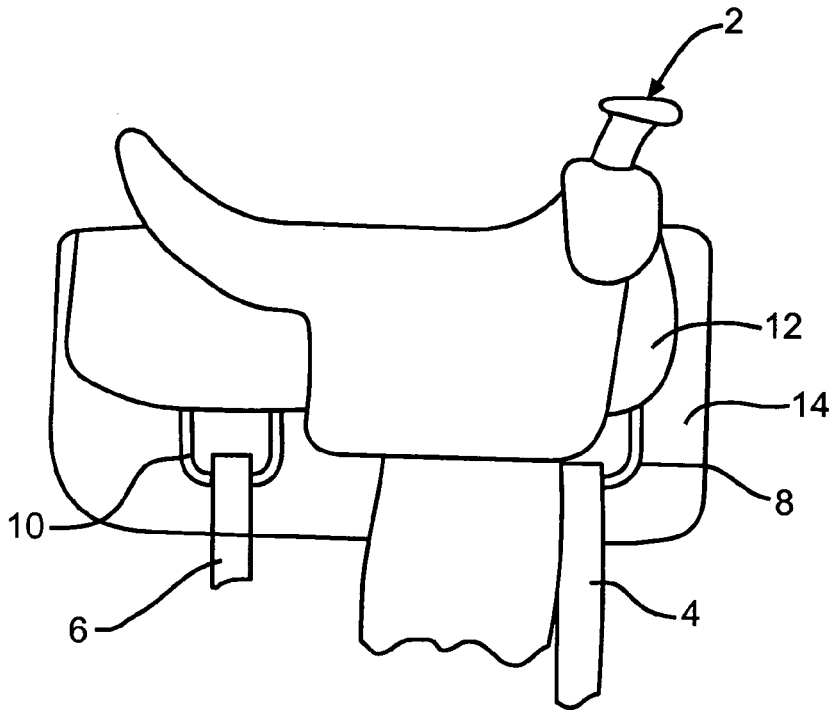
FIG. 1 PRIOR ART
FIG. 1 is a front view of a prior art saddle containing conventional front and back Dee rings.

FIG. 1 is a view of a prior art saddle 2 that will be used to show various parts and terms that will be used in the description of the invention. The saddle 2 is placed on the horses back and is secured to the horse with a front billet 4, and often a rear billet 6. The billets 4,6, usually leather straps, are attached to front and rear Dee rings, 8, 10 respectively, attached to the saddle 2 in various manners. The front Dee ring 8 can be attached to the tree directly or with one or more straps (not shown), but see U.S. Pat. No. 4,473,992, the disclosure being incorporated herein by reference, of leather or other strong material that can also be sewn to a skirts 12 and/or 14 of the saddle 2. To optimize the position of the saddle 2, and front billet 4 on the horse, it is desirable to use an adjustable Dee ring for Dee ring 8 so as to move the position of the billet 4 laterally with respect to the saddle 2. It is also desirable to use an adjustable Dee ring for the rear Dee ring 10 to optimize the position of the billet 6 on the horse.

Adjustable Dee rings are known as mentioned above, but are undesirably heavy, complex and require the billet to be either removed or loosened substantially to allow the bottom of the Dee ring to be lifted or pivoted a few inches in a generally vertically upward direction to change the lateral position of the Dee ring. This requires a significant amount of time after the horse has already been saddled. The adjustable Dee ring of the invention is light-weight, simple, and requires a generally vertical movement of less than about one inch, preferably much less, to enable movement of the Dee ring laterally to a desired position.

Figure 2:
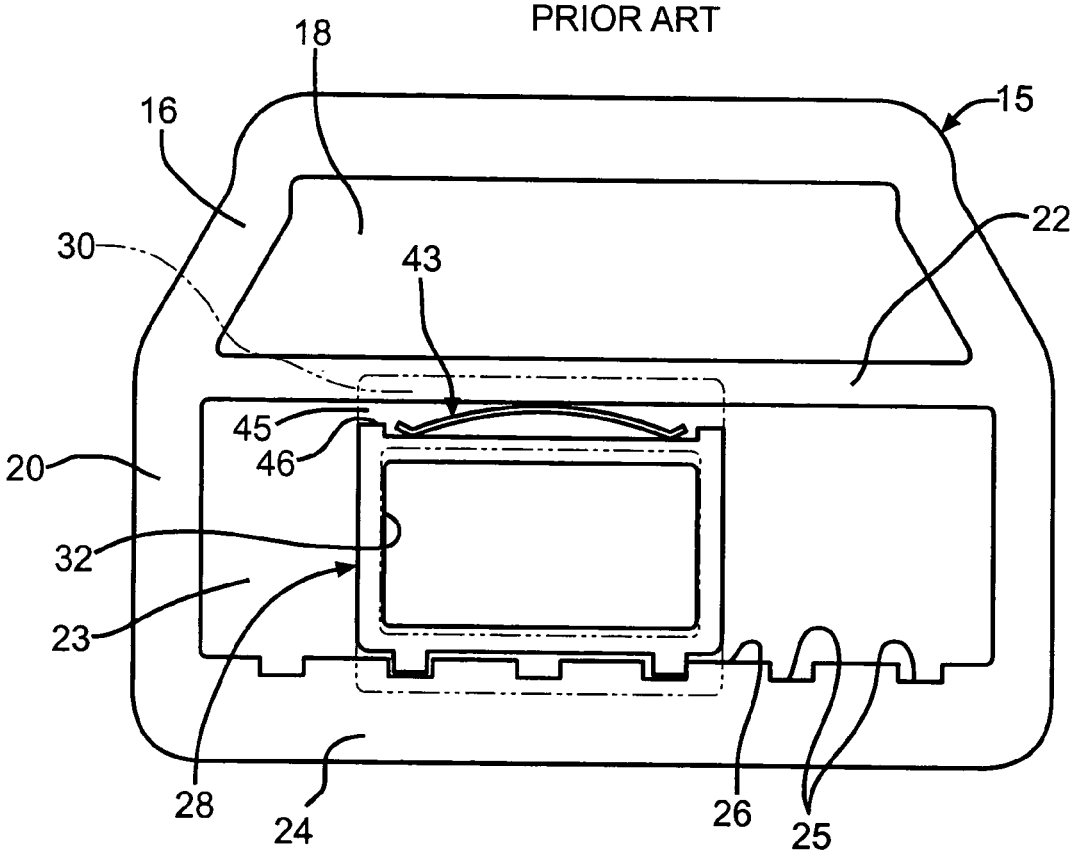
FIG. 2 is a vertical view of a preferred heavy duty adjustable Dee ring assembly of the present invention with one part removed to show details of members of the Dee ring.
Figure 3:
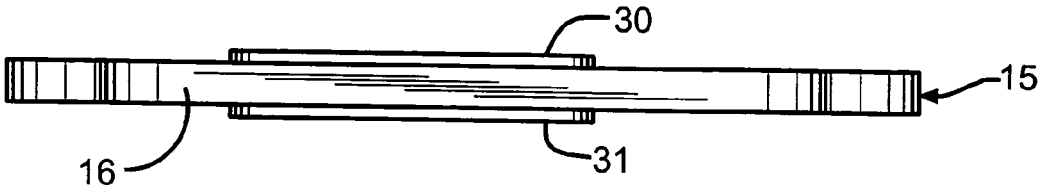
FIG. 3 is a plan view of the Dee ring assembly shown in FIG. 2.
Figure 4:
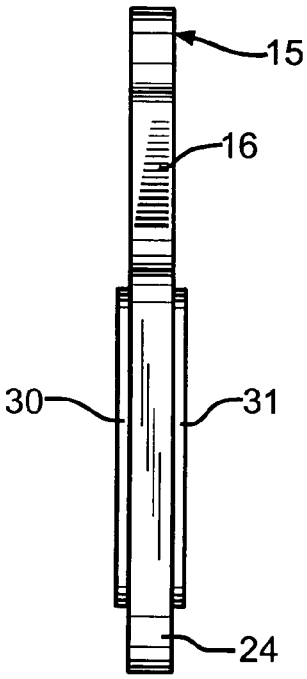
FIG. 4 is an end view of the Dee ring assembly shown in FIG. 2.

FIG. 2 is a vertical view, and FIG. 3 is a plan view, of a preferred heavy duty adjustable Dee ring assembly of the present invention with a cover plate removed to better see details of various members of the Dee ring. The adjustable Dee ring assembly of FIG. 2 includes a frame 15 that has an upper portion 16 surrounding an opening 18 for a billet strap (not shown) for attaching the Dee ring assembly to a saddle and a lower portion 20. In this embodiment, the upper portion 16 of the frame 15 and a cross-member 22, that spans from one side of the frame 15 to an opposite side, defines one side of the opening 18 and one side of a second opening 23 that is defined on the other three sides by the lower portion 20 of the frame, 15, are all one piece, but that is not necessary as will be seen later. In this embodiment a lower frame member 24 has a plurality of spaced apart slots or recesses 25 in its upper surface 26. The depth of the slots 25 should be less than about one inch, preferably less than about ½ inch, more preferably less than about ¼ inch and most preferably less than about ⅛ inch.

The second member of the adjustable Dee ring invention is a movable billet holding member 28. The movable billet holding member 28, in this embodiment, is preferably comprised of two or three elements, one or two face plates 30,31, (FIG. 6) and a locking member 32 shown in FIG. 5. The locking member 32 is preferably a square or rectangular shaped piece with a large opening 33, to reduce weight and to hold the billet, in its interior. The locking member 32 has four side members, preferably integral with each other, generally in the form of a picture frame surrounding the opening 33. Preferably a lower side member 35 has at least one projection 36 on its lower surface for engaging the recesses 25 in the lower frame member 24 of the frame 15, see FIG. 7, to lock the movable billet holding member 28 from moving laterally along the lower frame member 24 after the saddle has been cinched up on the horse. Preferably at least two projections 36 are used, but using only one is suitable for most embodiments and more than two can be used, e.g. two are used in this preferred embodiment, but three or more are also suitable.

The locking member 32 also comprises two side members 37,38 and an upper side member 39. The side members 37, 38 extend above the upper side member 39 to provide a recessed compartment 41 to hold a biasing member, such as a leaf spring 43. Any reasonable kind of biasing means that will bias the projections 36 into engagement with the slots 25 will be suitable including coil springs, various shapes of a compressible material like foam rubber or foam elastomer, or other types of springs, or elastic bands around the upper side member 39 and the cross member 22. The leaf spring 43, or other biasing member, can be replaced through a gap 45 (see FIG. 2) between a top surface 46 of side member 37 or 38 and the lower surface of cross member 22.

Figure 5:
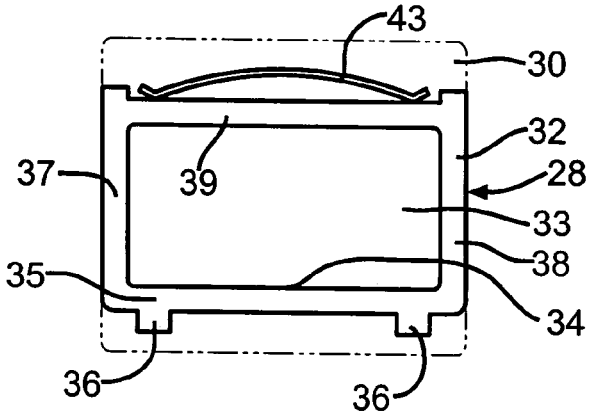
FIG. 5 is a vertical view of one member of a movable billet holding member shown in FIG. 2.
Figure 6:
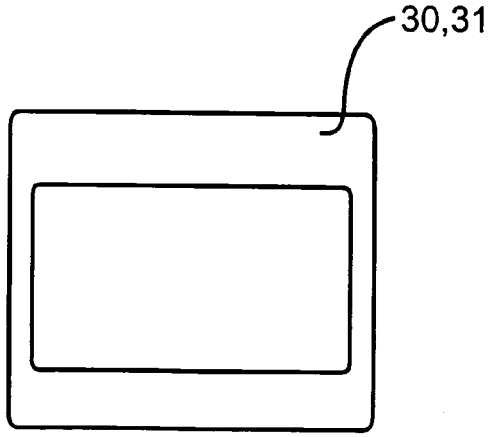
FIG. 6 is a vertical view of another member of the movable billet holder shown in FIG. 2.
Figure 7:
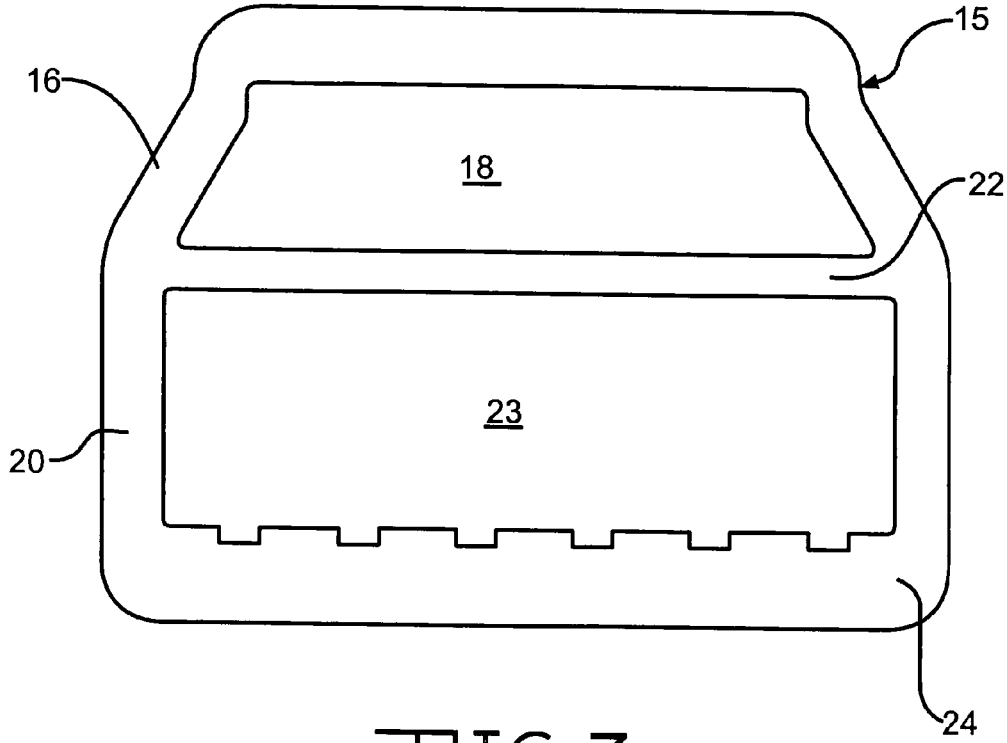
FIG. 7 is a vertical view of the heavy duty frame member shown in FIG. 2.

As shown in phantom in FIG. 5, one of the face plates 30 or 31 shown in FIG. 6 can be an integral part of the locking member 32 and the remaining face plate 31 can be attached to the locking member 32 after the locking member 32 is placed in its place in the second opening 23 in the lower portion 20 of the frame 15. The face plate 31 can be attached to the locking member 32 in any suitable secure manner such as rivets, screws, bolts, etc., but it is preferred to weld the face plate 31 to the two side members 37, 38 of the locking member 32 along at least a portion of the inside edges. Alternately, the face plates 30 and 31 can be separate pieces and both attached to the locking member in any suitable secure manner. Also, the face plates 30 and 31 and the locking member 32 can be combined in a single piece, especially when casting is the method of manufacture. In this instance, the frame 15 and 48 are made without cross members 22 and 53 (FIG. 8) respectively left off and then attached later after the one piece, movable billet holder 28 is installed. The cross members 22, 53, etc. can be attached by welding or by any suitable fastening means. The one piece movable billet holder 28 can be inserted into the frame 66 (FIG. 10) after the pivoting side member 67 has been opened.

In operation the face plates 30, 31, with their one side of their upper and l6wer portions facing the opposite surfaces of the cross member 22 and lower frame member 24 respectively maintain the locking member 32 in the proper position and keep it from falling out of the second opening 23.

To operate the adjustable Dee ring of FIGS. 2-7 with the billet residing in the opening 33 and loosened to allow sufficient vertical movement of the movable billet holding member 28, the movable billet holding member 28 is raised vertically against the biasing member 43 to disengage the projections 36 from the slots 25 and moved laterally to the desired position and then lowered to engage the projections 36 into different slots 45. The billet is then re-tensioned and the rider is ready to remount, this adjustment requiring only several seconds.

Figure 8:
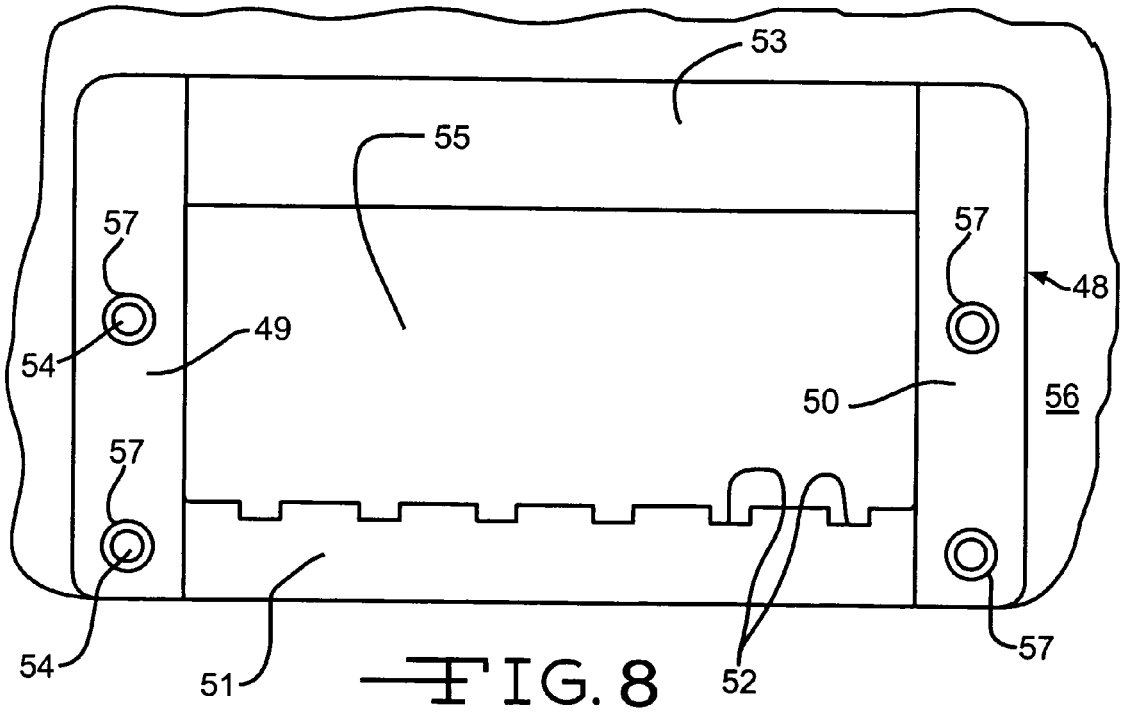
FIG. 8 is a vertical view of a normal duty frame member for the adjustable Dee ring assembly.

For a normal duty adjustable Dee ring the frame 15 is replaced with a different type of frame such as the frame 48 shown in FIG. 8. This frame 48 is preferably in one piece comprising two generally vertical side portions 49, 50, a lower frame portion 51 having a plurality of spaced apart slots 52 in a top surface, and a cross member 53 extending between the two vertical side portions 49, 50 below the tops of the vertical side portions 49, 50. The vertical side portions 49, 50 can be thinner than the remainder of the frame. A preferred thickness is 0.15 inch. Holes 54 in the vertical side portions 49, 50, can be used to attach the adjustable Dee ring to a saddle skirt 56, or other part of the saddle, preferably using rivets 57. A movable billet holding member 28 would be assembled in the opening 55 bounded by the cross member 53, the two vertical side portions 49, 50 and the lower frame portion 51 in the same manner as shown in FIG. 2.

Figure 9:
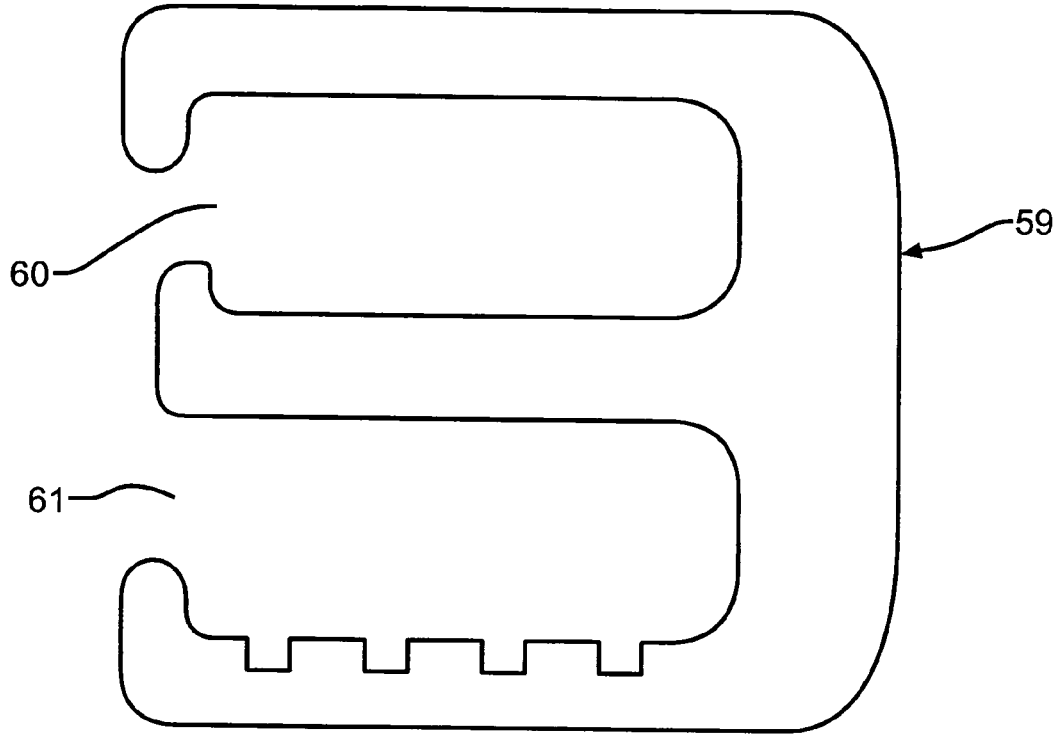
FIG. 9 is a vertical view of a light-normal duty frame that can be used in the adjustable Dee ring assembly shown in FIG. 2.

The frames 15 and 48 can be of different shapes,as long as the essential functions described above are maintained. The frames 15 and 48 need not be a single piece. Although not preferred, they can be made of two or more pieces that are attached together by rivets, welding, screws or other suitable fastening means. For light duty the frames need not be closed. FIG. 9 shows an open frame that allows the adjustable Dee ring to be more easily removed if desired. This open frame 59 has a gap 60 to allow the frame 59 to be removed from a strap holding the frame 59 on the saddle. The lower portion of the frame can also be open if desired as shown in this embodiment by leaving a second gap 61 in one side of a lower portion of the frame 59. A lip 63 at the end of a lower portion 64 of the frame 59 prevents the movable billet holding member 28 (FIG. 2) from slipping out of the frame 59 when the saddle is not in use. With strong enough material used to make the frame 59, it can be used for normal duty or even heavy duty.

Figure 10:
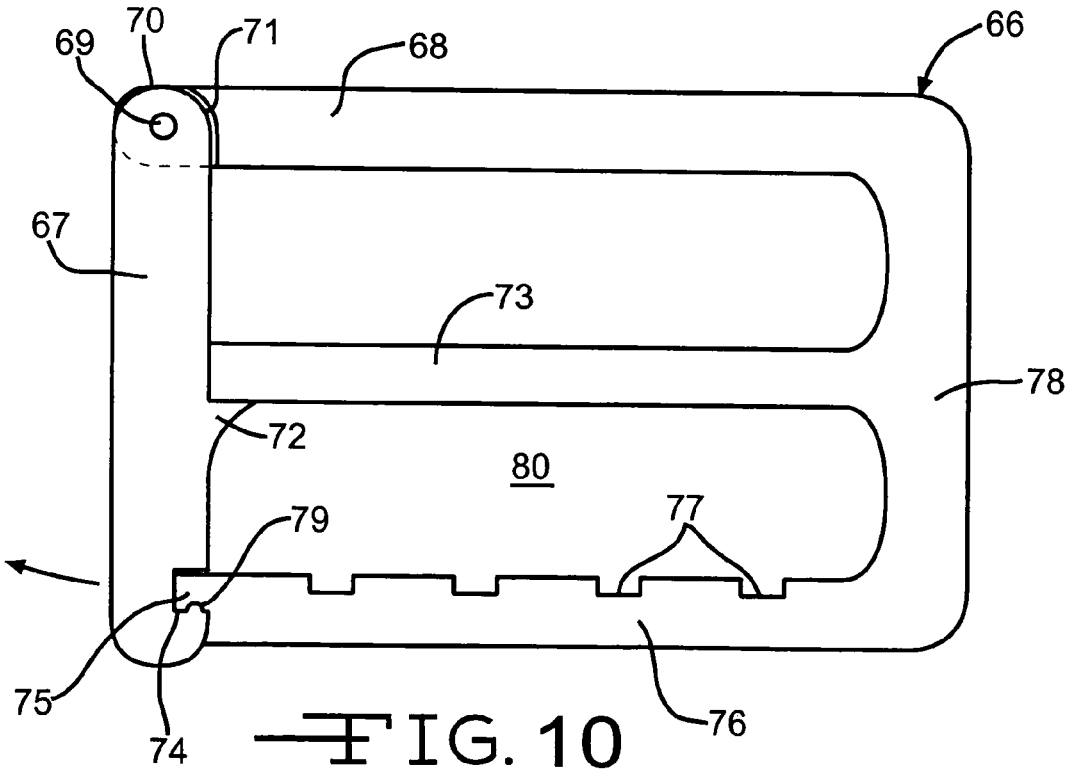
FIG. 10 is a vertical view of a different heavy duty frame useable in the adjustable Dee ring assembly shown in FIG. 2.
Figure 13:
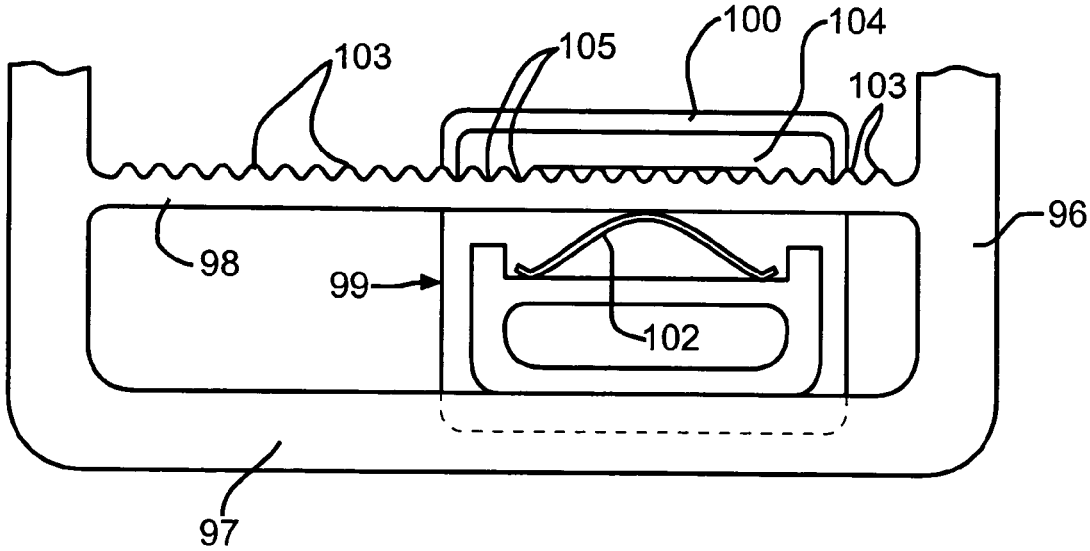
FIG. 13 is a partial vertical view, with a front plate removed for better illustration of components, of another embodiment of the present invention.
Figure 14A:
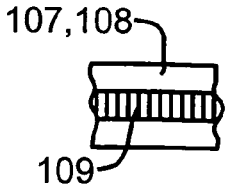
FIG. 14 is a plan or bottom view of engaging surfaces on some embodiments of the invention.
Figure 14B:
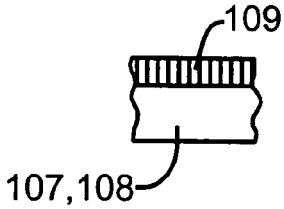
Figure 14C:
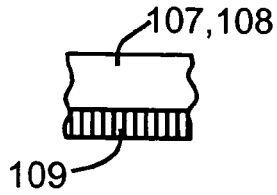
Figure 14D:
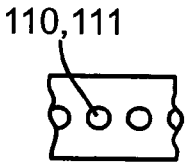
Figure 14E:
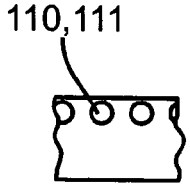
Figure 14F:
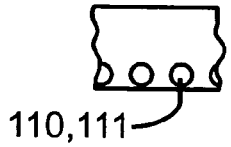

The frame can be made to be closed during use, but also opened at various times to remove the adjustable Dee ring or to remove the movable billet holder. FIG. 10 shows such an opening frame 66. In this frame 66 a pivoting vertical side member 67 is pivotly attached to an end of a top member 68 with a pin 69 in a hole near a radiused top end 70 of the vertical side member 67. The pin 69 also runs through a hole in a reduced thickness end portion 71 of the top member 68. The pivoting vertical side member 67 can optionally have a projection 72 on the side facing a vertical center-line of the frame 66 to serve as a support for a center horizontal member 73, but this is usually not necessary as there is very little downward stress on the member 73. Projection 72 can be used when using a surface of the cross member 73 as an engaging surface as shown in FIG. 13. The pivoting vertical side member 67 has a recess 74 in a lower end portion of the pivoting vertical side member 67. The recess 74 engages a projection 75 on the end of a lower horizontal frame member 76, the latter having spaced apart recesses 77 along a top side as the frame 15 in FIG. 2. A raised portion 79, preferably on a lower surface of the recess 74 engages a similar shaped recess in a surface of the projection 75 to keep the pivoting vertical side member 67 in place during operation of the saddle.

By springing the projection 75 end portion of the lower horizontal member 76 upward slightly to unlock the raised portion 79, the pivoting vertical side member 67 can be opened by pivoting it outwardly to permit a movable billet holder 28 (FIG. 2) to be removed or inserted into an opening 80. The upper horizontal member 68 is held by the saddle with a strap in the same manner as the frame 15 in FIG. 2. The top horizontal member 68, the center horizontal member 73, the lower-horizontal member 76 and a second vertical member 78 are preferably integral but can be separate pieces attached together. The pivoting member can be either vertical-side member or even the lower horizontal member.

Figure 11:
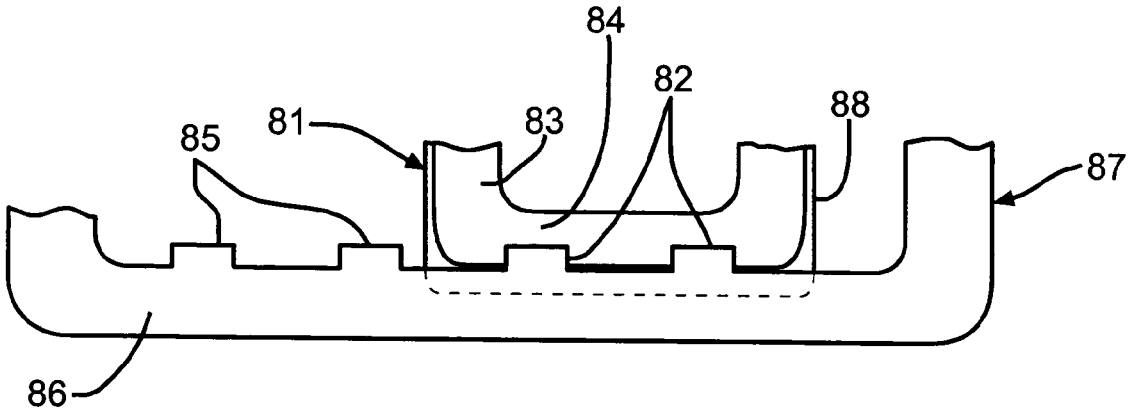
FIG. 11 is a partial vertical view of another embodiment of the invention.

Many different configurations can be used to hold the movable billet holder in.place during operation of the saddle on the horse while also allowing rapid and easy adjustment of position of the movable billet holder in the frame of the adjustable rigging. Some of the preferred configurations are shown here to illustrate this fact. FIG. 11 is a partial vertical view of a portion of a movable billet holder 81 with a front plate removed to show the locking member 83 having one or more spaced apart recesses 82 in a lower surface of a lower member 84 of the locking member 83. The one or more recesses 82 are filled with one or more of projections 85 on a top surface of a lower member 86 of a frame 87. Back plate 88 attached to, or a part of, the locking member 83 is also shown in this figure. While the projections 85, and projections 36 in FIG. 5, are shown with square corners, the corners can be radii or the projections can be semi-circular or an arc.

Figure 12:
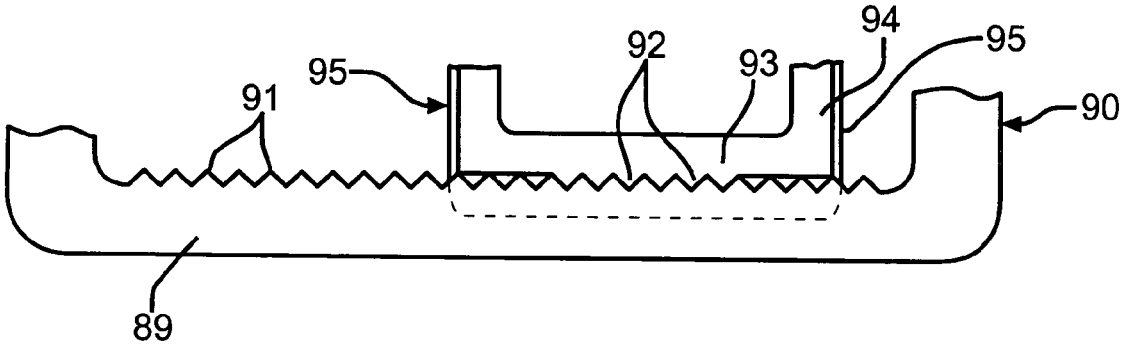
FIG. 12 is a partial vertical view of another embodiment of the invention.

FIG. 12 is a partial vertical view of another embodiment of the invention with a front plate removed from a locking member 94 to better show the locking member 94. In this embodiment a top surface of a lower horizontal member 88 of a frame 89 has a plurality of saw-teeth 91 along all, most of or at least a part of its length. Optionally spaced apart lengths of saw-teeth 91 can be appropriately placed along the length of the top surface. Engaging saw-teeth 92 extend along at least a portion of the length of a lower surface of a lower horizontal member 93 of the locking member 94. Also shown is the back plate 95 which can be a separate part attached to the locking member 94, or an integral part of the locking member 94. It is possible with this embodiment to provide a fine adjustment and optimization of the position of the movable billet holder 95 in the frame 90.

The locking engagement need not occur on the lower horizontal frame member, but can occur on the center horizontal member. FIG. 13 shows a partial vertical view of an embodiment of the invention in which the locking engagement occurs on a top surface of a different horizontal member, which can be an upper horizontal member in a frame 48 shown in FIG. 8 or a central horizontal member shown in FIGS. 7 and 10. For purposes of illustration and simplicity, FIG. 13 shows this different feature of the invention on a frame 96, the type of frame shown in FIG. 8. In this embodiment the top surface of the lower horizontal member 97 can be smooth, but the top surface of a higher horizontal member 98, spaced above the lower horizontal member 97, has a plurality of saw-teeth 103 along all, most of or at least a part of its length. Optionally spaced apart lengths of saw-teeth 91 can be appropriately placed along the length of the top surface.

The movable billet holding member 99 is comprised of a front plate, not present in this figure to better show the interior parts of the movable billet holding member 99, a back plate 100, a biasing means holding member 101, a biasing spring 102, and a locking member 104 having engaging saw-teeth 105 on at least a portion of its lower surface. The locking member 104 and the biasing means holding member 101 are spaced apart on opposite sides of the higher horizontal member 98 and can integral with either the back plate 100 or the front plate (not shown). In any case it is preferred that these parts be attached in a suitable manner to both the front plate and back plate 100. The biasing spring 102, here a leaf spring, is held in place in the same manner as in the movable holding member 28 in FIG. 2. The biasing means holding member 102 also has an opening 106 in its interior to hold the billet. The saw-teeth 103 and 105 can be replaced with any reasonable kind of projection and recess as described and reasonably suggested above.

The engaging members need not extend entirely across the frame member, but can be on only a portion of the frame member as shown in FIGS. 14 A–F and 15 A–C. FIG. 14A shows saw-teeth 109 in an interior portion of an engaging surface of either a frame member 107 or a locking member 108, 14B shows saw-teeth along a back edge portion, and 14C show saw-teeth along a front edge portion. In all of the A–C views, that portion of the surface not having saw-teeth can be at a lower or equal elevation than the ends of the saw-teeth, i.e. the saw-teeth can be recessed or can project above the smooth part of the surface. In all of the embodiments having saw-teeth it is preferred that all of the saw-teeth be of the same shape, but this is not necessary if different shapes or sizes are arranged in a repeating pattern to indicate normal positions for placing the movable billet holding member in the frame.

FIG. 14, D–F, partial plan views of a portion of a lower horizontal member on an adjustable Dee ring frame, or partial upward views of a portion of a locking member of a movable billet holder, show different embodiments for the placement of engaging, spaced apart projections 109, 110, or engaging spaced apart recesses 109A, 111 in either an engaging surface of a frame member 107 or in an engaging surface of a locking member 108 to perform in the manner described.for the embodiments shown in FIGS. 12 and 13. FIG. 14A shows a plurality of either raised saw teeth 109 or saw teeth recesses 109A in a center portion of the members 107, 108. FIGS. 14B and 14C show a plurality of either raised saw teeth 109 or saw teeth recesses 109A in along different edge portions of the members 107, 108. FIGS. 14 D–F show similar embodiments, but with round pin shaped depressions 110 or projections 111, the latter fitting easily into the depressions 110.

Figure 15A:
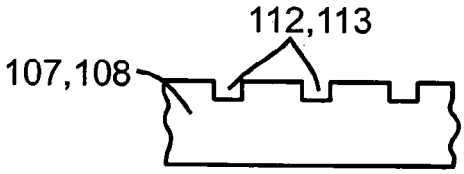
FIG. 15 is a plan or bottom view of other engaging surfaces of additional embodiments of the invention.
Figure 15B:
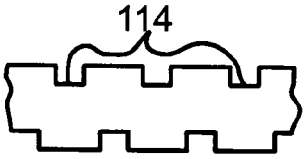
Figure 15C:
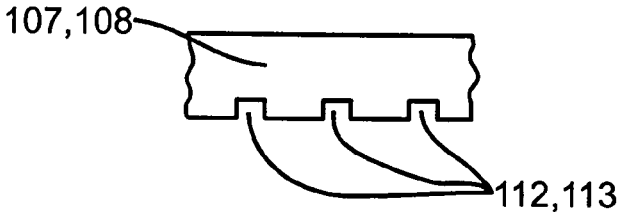

FIG. 15 views A–C show that engaging projections and engaging recesses or slots can be in one or both outer surfaces of a horizontal frame member or a horizontal member of the locking member. FIG. 15A shows spaced apart engaging projections 112 or spaced apart engaging recesses 113 on or in a back edge portion of a frame member 107 or a locking member 108. Instead of recesses 113, the engaging members can be slots 114 spaced apart along an outside edge portion of the frame member 107 or the locking member 108, and the slots, recesses or projections can be on both front edge portions and back edge portions as shown in FIG. 15B. Spaced apart engaging projections or spaced apart engaging recesses 113 can be on a front edge portion of the engaging members as shown in FIG. 15 C.

In the present invention, the shape of the engaging projections or engaging recesses, slots, etc. are not critical so long as they engage each other readily and prevent the billet holder from moving laterally significantly while the adjustable Dee ring of the invention is in operation on a saddle on an animal, except when it is desired to relocate the billet as described above. Given the disclosure herein, an ordinary artisan can visulize a long list of engaging shapes operable in the present invention to achieve the same result and advantages thereof, and those embodiments are included within the scope of the claims below.

The frames and other parts of the adjustable Dee ring of the invention are preferably made from a non-corrosive material such as stainless steel, cast iron, or fiber reinforced plastic, although for light duty some woods are suitable, especially if reinforced with rawhide. Also, different parts can be made from different materials because some parts do not require as much strength as other parts. The preferred material is stainless steel. To make the adjustable Dee ring lighter in weight, optional holes 57 or thin areas can be formed, milled or drilled in non-critical areas of the frames 15 and 48 and also in the plates 30, 31 and even in the locking member 32. The cross section of the frames used in the invention can be of various shapes including round, square, rectangular, oval, other shapes and any combination thereof.

The shape or size or location of the projections is not critical so long as at least one projection engages a recess in such a manner as to prevent significant relative movement between the frame and the movable billet holder while the saddle is in use on an equine. Clearances required between the surfaces of the projections and the surfaces of the recesses needed to allow easy and rapid adjustment of the adjustable rigging allow slight relative movement, but this is non-significant relative movement. Any or all interior and exterior corners can be either square, angled or curved with a reasonable radius. The following examples illustrate two preferred adjustable Dee ring assemblies of the present invention.

EXAMPLE 1

An adjustable Dee ring like that shown in FIGS. 2–7 contained a frame having outside dimensions of an outside lower width of about 5.375 inches, an outside upper width of about 4.3125 inches, an outside height of 4.125 inches. The frame was made of 0.1875 inch thick stainless steel and the cross section of the frame was rectangular in most places. The height of the lower member of the frame was 0.625 inch and the engaging recesses in top surface of the lower frame member were 0.09375 inch deep and 0.25 inch wide and the recesses were spaced apart about 0.5 inch along the top of the lower frame member. The width of the vertical side members was about 0.375 inch and the height of the center horizontal member was about 0.25 inch. The opening in the frame for the movable billet holding member was about 1.625 inches high by about 4.625 inches wide. The vertical dimension of the upper frame member was about 0.5 inch and the size of the opening in the frame between the center horizontal member and the upper frame member was about 1.125 inches high by about 4.625 inches wide at the bottom of the opening and about 3.5625 inches wide at the top of the opening. The locking member was about 2.25 inches wide and about 1.5625 inches high. The vertical side members were about 0.125 inch wide while the upper horizontal member was about 0.25 inch high. The surface supporting the biasing leaf spring was about 0.0625 inch below the top of the vertical side members. The projections on the bottom of the locking member were about 0.25 inch wide and projected about 0.0625 inch beyond the non-engaging surface of the locking member. The locking member was about 0.1875 inch thick. The opening in the locking member was about 2 inches wide and about 1 inch high and the inside corners had a radius of about 0.125 inch.

The front and back plates of the movable billet holder were identical and were about 2.25 inches wide by about 2.125 inches high and both the outside and inside corners had a radius of about 0.125 inch. The opening in each plate was centered both height wise and width wise and was about 2 inches wide by about 1.125 inches high. The front and back plates were welded to the locking member, with the locking member in the opening of the frame and in an engaged position with the engaging projections in the recesses in the lower frame member, along a portion of both inside vertical edges to securely hold the three pieces together. The front and back plates were attached to the locking member such that the upper edges of the front and back plates overlapped the center horizontal frame member about 0.1875 and the lower edges of the front and back plate overlapped the bottom frame member about 0.3125 inch.

This adjustable Dee ring was attached to a saddle with a leather strap running through the top opening. The strap was attached to the tree of a saddle and also was sewn to other parts of the saddle. When a billet was in place in the opening of the movable billet holder of the Dee ring and cinched up tight on a horse, the billet needed only slight loosening to allow the movable billet holder to be raised only about 0.1 inch to allow the movable billet holder to be moved laterally to a more optimum position in the frame of the Dee ring. Also, this adjustable Dee ring weighed only about 0.6 pounds and performed well in heavy duty activities like calf and steer roping.

EXAMPLE 2

Another adjustable Dee ring assembly was made using a frame like that shown in FIG. 8. The frame had an outside width of about 6.125 inches and the frame was made of stainless steel about 0.1875 inch thick. The vertical side members had an outside height of about 2.65 inches and a width of about 0.75 inch. The tops of the vertical side members had a radius of about 0.375 inch. The mounting holes had a diameter of about 0.165 inch The upper cross member had a height of about 0.375 inch. The opening between the lower frame member and the upper frame member, and the parts of the movable billet holding member had the same dimensions and construction as the Dee ring of Example 1. This adjustable Dee ring, performed the same in normal or light duty as the Dee ring of Example 1. This Dee ring had a weight of about 0.52 pounds.

FIG. 16 is a perspective view showing another embodiment of the invention. In this embodiment a normal duty frame 116 is comprised of two vertical members 117 and 118 and a horizontal cross member 119. Upper end portions of the vertical members 117 and 118 are preferably flattened out and holes 120 are drilled for attaching the frame 116 to the skirt of a saddle with rivets or other suitable attachment fasteners. Both vertical members 117 and 118 can be about 90 degrees to the horizontal member 119 or can be at any angle of from about 30 to about 130 degrees. A preferred angle for at least the vertical member towards the rear of the saddle is about 120 degrees. Encircling the horizontal member 119 are a plurality, at least two, spacers 124 that fit loosly around the horizontal member so that they can be slid along the member 119 laterally. The horizontal member holds the billet or Latigo 122. The spacers 124 hold the billet 122 at the desired position on the horizontal member 119 when the saddle is in operation on an animal. The spacers 124 can be leather or any other material, including metal or plastic, having a thickness of at least about 0.06 inch, preferably at least about 0.1 inch.

FIG. 16A is a cross section through the billet 122 in FIG. 16 and shows how the spacers 124 can be slid through a loop opening 123 formed by the billet wrapping around the horizontal member 119 of the frame 118. The spacers 124 fit loosely enough on the horizontal member 119 so they can be slid along the horizontal member 119, but not so loosely that they would not hold the billet 122 in the desired position on the horizontal member 119.

FIG. 17 is a front vertical view of the embodiment of the invention shown in FIGS. 16 and 16A, but on a heavy,duty frame 125. The heavy duty frame is attached to the saddle in the same manner as the frame 16 shown in FIG. 7. The shape of the frames 125 and 16 are not critical so long as they comprise a horizontal member at the bottom to hold a billet or movable billet holder and a horizontal member at the top to attach to a strap attached to the saddle, and at least one generally vertical member connecting the bottom and top horizontal members together. The shapes of the frames. such as 48 and 116 and other normal or light duty frames are not critical so long as they comprise at least one horizontal member for holding the billet or movable billet holder and at least one generally vertical member on each side of the billet or movable billet holder for attaching to an element of the saddle, such as a skirt of the saddle. Generally vertical preferably means they approach the element of the saddle at an angle in the range of about +/−60 degrees from vertical, most preferably in the range of about +/−30 degrees from vertical.

FIG. 17 shows a typical way that the billet or Latigo is fastened around the frames 125, 116, etc. using a Latigo string 128 passing through holes 127 in the billet or Latigo in the known manner.

Many different embodiments and optional features and variations have been described and reasonably suggested above. Also, any reasonable combination of the above variations can be used. The above disclosure will also suggest many other embodiments to one of ordinary skill in the art and all of these embodiments are considered to be within the scope of the invention and are intended to be included in one or more of the following claims

The invention claimed is:

1. An adjustable Dee ring for attaching to a saddle to hold a latigo or billet, the adjustable Dee ring comprising a frame having a generally lateral lower frame member, a cross member and at least one side joining the lower frame member and the cross member, and a movable billet or latigo holding member having an opening therein wide enough to receive the latigo or billet, the movable billet holding member being movable generally laterally between the generally lateral lower frame member and the cross member only after moving said billet holding member generally vertically upward a distance of less than about one inch within the frame to disengage the movable billet or latigo holding member from an engaging feature of the frame, the movable billet holding member being held in a substantially laterally locked position by engaging the engaging feature of the frame while the billet or latigo is in operating condition on an equine, the width and spacing of the engaging feature being such as to permit lateral adjustment increments of the movable latigo or billet holding member that are substantially less than a width of the billet or latigo the adjustable Dee ring also comprising a spring or compressible member that tends to move the movable billet holding member in the substantially laterally locked position.

2. The adjustable Dee ring of claim 1 wherein the generally vertical distance is less than about 0.5 inch.

3. The adjustable Dee ring of claim 2 wherein the cross member, the generally lateral member and two side members are integral with each other or are connected together to form an enclosure around the movable billet holding member.

4. The adjustable Dee ring of claim 1 wherein the generally vertical distance is less than about 0.25 inch.

5. The adjustable Dee ring of claim 4 wherein the cross member, the generally lateral member and two side members are integral with each other or are connected together to form an enclosure around the movable billet holding member.

6. The adjustable Dee ring of claim 3 wherein the frame is open on one side.

7. The adjustable Dee ring of claim 1 wherein the generally vertical distance is less than about 0.125 inch.

8. The adjustable Dee ring of claim 1 wherein the cross member, the generally lateral member and two side members are integral with each other or are connected together to form an enclosure around the movable billet holding member.

9. The adjustable Dee ring of claim 1 wherein the frame is open on one side.

10. A method of making a saddle comprising attaching one or more Dee rings to an element of the saddle, the improvement comprising that the Dee ring is an adjustable Dee ring that comprises a frame having a generally lateral member, a cross member, at least one side member joining the generally lateral member and the cross member and a movable billet or latigo holding member, the movable billet or latigo holding member being movable generally laterally between the generally lateral member and the cross member only after moving said member only generally vertically upward a distance of less than about one inch within the frame to disengage the movable billet or latigo holder from one or more locking features of the frame, the movable billet or latigo holding member being held in a substantially laterally locked position by engaging the at least one locking feature of the frame while the billet or latigo is in operating condition on an equine, the width of the engaging features being such as to permit lateral adjustment increments that are less than a width of the billet or latigo the adjustable Dee ring also comprising a spring or compressible member that tends to move the movable billet holding member in the substantially laterally locked position.

11. An adjustable saddle Dee ring for holding a latigo or billet, the adjustable Dee ring comprising a frame having a generally lateral member, a cross member, at least one side joining the generally lateral member and the cross member and a movable latigo or billet holding member having an opening therein wide enough to receive the latigo or billet, the movable latigo or billet holding member being movable generally laterally between the generally lateral member and the cross member only after moving said billet holding member generally vertically upward a distance of less than about one-half inch to disengage the movable latigo or billet holding member from an engaging feature of the frame, the movable billet holding member being normally held in a substantially laterally locked position by an engaging feature on the movable latigo or billet holding member that engages the engaging feature of the frame while the billet is in operating condition on an equine, the width of the engaging features being such as to permit lateral adjustment increments of the movable latigo or billet holding member that are less than a width of the billet or latigo the adjustable Dee ring also comprising a spring or compressible member that tends to move the movable billet holding member in the substantially laterally locked position.

12. The adjustable saddle Dee ring of claim 11 wherein the vertically upward distance is equal to or less than about 0.25 inch and wherein the engaging feature is such as to permit lateral adjustment increments of about 0.5 inch or less.

13. An adjustable Dee ring for attaching to a saddle to hold a latigo or billet, the adjustable Dee ring comprising a frame having a generally lateral member and a movable billet or latigo holding member having an opening therein wide enough to receive the latigo or billet, the movable billet holding member being movable generally laterally only after moving said billet holding member generally vertically upward a distance of less than about one inch within the frame to disengage the movable billet or latigo holding member from an engaging feature of the frame, the movable billet holding member being held in a substantially laterally locked position by engaging the engaging feature of the frame while the billet or latigo is in operating condition on an equine, the width and spacing of the engaging feature being such as to permit lateral adjustment increments of the movable latigo or billet holding member that are substantially less than a width of the billet or latigo, the adjustable Dee ring also comprising a spring or compressible member that tends to move the movable billet holding member into the substantially laterally locked position.

14. The adjustable Dee ring of claim 13 wherein the frame comprises a cross member, a bottom member and at least one side member integral with each other or connected together to form an enclosure around the movable billet holding member.

15. The adjustable Dee ring of claim 14 wherein the distance is less than about 0.5 inch.

16. The adjustable Dee ring of claim 14 wherein the distance is less than about 0.25 inch.

17. The adjustable Dee ring of claim 14 wherein the distance is less than about 0.125 inch.

* * * * *